US005779031A

United States Patent [19]

Moraine et al.

[11] Patent Number: 5,779,031

[45] Date of Patent: Jul. 14, 1998

[54] LARGE CALIBRE MUNITION CONTAINER

[75] Inventors: Gérard Moraine, Chaville; Gilles Capitani, La Castera; André Ferrandez, Eysines; Yves Hazard, Cerny, all of France

[73] Assignee: Tiag Industries, Villacoublay, France

[21] Appl. No.: 676,123

[22] PCT Filed: Jan. 29, 1996

[86] PCT No.: PCT/FR96/00147

§ 371 Date: Aug. 9, 1996

§ 102(e) Date: Aug. 9, 1996

[87] PCT Pub. No.: WO96/24023

PCT Pub. Date: Aug. 8, 1996

[30] Foreign Application Priority Data

Jan. 30, 1995 [FR] France ..... 95/01031

[51] Int. Cl.[6] ..... F42B 37/00

[52] U.S. Cl. ..... 206/3; 206/317; 206/592; 220/4.24; 220/4.33

[58] Field of Search ..... 206/3, 317, 521, 206/523, 524, 587, 591, 592; 220/324, 326, 4.24, 4.26, 4.33

[56] References Cited

U.S. PATENT DOCUMENTS

| | | | |
|---|---|---|---|
| 2,052,491 | 8/1936 | Rueppel | 206/3 |
| 2,308,480 | 1/1943 | Abbott et al. | 206/3 |
| 4,055,247 | 10/1977 | Benedick et al. | 206/3 |
| 4,159,764 | 7/1979 | Schinke | 206/3 |
| 4,279,339 | 7/1981 | Gotter | 206/3 |
| 4,347,929 | 9/1982 | Poe et al. | 206/3 |
| 4,722,436 | 2/1988 | Moraine | 206/3 |
| 4,762,222 | 8/1988 | Martin | 206/3 |
| 5,492,243 | 2/1996 | Brandhorst | 220/4.24 |

FOREIGN PATENT DOCUMENTS

| | | |
|---|---|---|
| 0 164 150 | 12/1985 | European Pat. Off. . |
| 1 601 106 | 8/1970 | France . |
| 2 369 180 | 5/1978 | France . |
| 2 477 697 | 9/1981 | France . |
| 2 477 698 | 9/1981 | France . |
| 2 597 075 | 10/1987 | France . |
| 2 685 469 | 6/1993 | France . |
| 66259 | 10/1972 | Luxembourg . |

*Primary Examiner*—Paul T. Sewell
*Assistant Examiner*—Luan K. Bui
*Attorney, Agent, or Firm*—Oliff & Berridge, PLC

[57] ABSTRACT

A container for large caliber munitions of the type formed of an outer envelope closed by a cap. The container having an inner envelope demarcating means to prevent the translation of the projectile of the munition with respect to a case enclosing the munition, load and locking mechanism applied to the base of the munition, the locking mechanism ensuring immobilization along the three axes of the munition in the inner envelope, and a mechanism to immobilize the inner envelope along the three aforementioned axes with respect to the outer envelope.

16 Claims, 5 Drawing Sheets

LARGE CALIBRE MUNITION CONTAINER

BACKGROUND OF THE INVENTION

1. Field of the Invention

The technical scope of the present invention is that of containers for large caliber munitions.

2. Description of Related Art

Large caliber munitions are characterized by their bulk as they have a high mass (15 to 30 kg) and are very long (1 to 2 m). These munitions are composed of a projectile and a propellant charge contained in a case, combustible or not, crimped onto the projectile. The projectiles can be fin-stabilized, shaped charge projectiles, incendiary projectiles, or training explosives. Admittedly, these munitions are not very easy to handle and require protection. The types of protection currently in use are generally constituted by containers incorporating wedging means for the munition and are perfectly well-adapted to everyday handling.

By way of illustration, reference may be made to French Patents: 1 601 106, 2 597 075, 2 477 698, 2 369 180, 2 685 469 which describe containers of this type. However, they have the serious disadvantage of not protecting the munition against excessive stress, and this problem must at all costs be resolved with respect to the transportation of dangerous substances.

Wooden containers are not watertight and provide no shock-absorption in the event of a fall. Metal containers provide next to no shock-absorption in the event of a fall. This is all the more disadvantageous in that the inner volumes are more and more restricted due to the constraints imposed on the outer dimensions with regard to transportation and due to the system of palletizing which thus limits substantially the possible volumes of wedging materials. Moreover, they require painting which does not remove the likelihood of corrosion. Containers made of synthetic materials provide good performances when the stress remains moderate such as is the case, for example, of a fall of 2.10 m in height at a temperature of between −40° C to +63° C. As a general rule, for this height, the performances of the munition are entirely preserved by this plastic container.

But, when the stress is greater, for example, during a fall of 12 m in temperatures of between −40° C. to +60° C., a significant initiation rate may frequently be noted, which is not acceptable for the safety of the users.

SUMMARY OF THE INVENTION

The aim of the invention is to propose a container to protect a munition against excessive stress which prevents any accidental initiation of the munition.

The subject of the invention is thus a container for large caliber munitions of the type structured by an outer envelope closed by a cap. The container has an inner envelope demarcating means to prevent the translation of the projectile of the munition with respect to a case enclosing the munition load and locking means applied to the base of the munition, the locking means immobilizing the projectile along the three axes of the munition in the inner envelope (the inner envelope also having a tapered outer part on one end and a cylindrical part extended by a radial bottom on the other), a head wedge placed in the outer envelope fitted with a recess demarcating a tapered inner profile which matches the outer profile of the inner envelope, a side wedge placed between the inner and outer envelopes, and a bottom wedge applied against the radial bottom of the inner envelope and compressed by the cap.

According to one characteristic of the invention, the head wedge has a cylindrical inner profile extending from the inner tapered profile.

Applied to a fin-stabilized munition, the means to prevent translation, according to one characteristic of the invention, are composed of a first means to prevent the translation of the projectile of the munition with respect to the case enclosing the munition load and a second means to prevent translation of the load with respect to the projectile. The blocking means are also constituted by circular supports bearing firstly on the projectile and secondly on the load envelope, for example, the circular supports are marked out by folds of the inner envelope itself which is composed of two half-shells joined by linking means.

Applied to a shaped charge munition, the means to prevent the translation of the projectile with respect to the case are composed of a hooking support working in conjunction with the flange of the projectile. Additionally, the inner envelope is fitted with two bearing supports on the projectile in the vicinity of the end of the case.

According to one embodiment, the linking means are composed of a snap-locking means placed on the body of the inner envelope and by a frog latch placed in the vicinity of the radial bottom, and the snap-locking means are provided by a claw marked out by extensions to the wall of the two half-shells, the latter each having a bearing rim along their join line.

Lastly, according to another characteristic of the invention, the inner envelope is composed of injection-molded polyamide, reinforced by glass fibers and having cut-outs of a material.

A first advantage of the invention lies in the exact wedging of the munition at the level of the components themselves.

A further advantage lies in the fact that the munition is locked in an envelope to which are applied wedging means.

Another advantage lies in the fact that all the parts making up the container are made by extrusion blow-molding and/or injection.

Thus, the invention:

1. Allows the deformable parts of the munition to be blocked so as to prevent any relative movement which would risk damaging or initiating sensitive pyrotechnic parts.

2. Ensures shock-absorption whatever the fall position by means of:

a. the outer structure of the container being suitably sized with the body and the lid handle;

b. the inner wedging being made of a cellular material whose density and geometry ensure the second shock-absorbing phase, the first phase having more or less reached its peak; and c. the blocking shells being made of reinforced polymer whose size and skeleton type structure provide resistance while completing the shock-absorption.

3. Guarantees the aforementioned functions in extreme dispersal limits, and in manufacturing the munition, this with no additional machining, intervention or even adjusting or backlash elimination systems. This is ensured by the shell concept in the area providing the locking of the base and a collection of grooves constituting a variable locking area enabling final locking when the frog latch is closed, whatever the length of the munition.

4. Allows, during tactical and strategic use, the munition to be extracted very quickly (less than 10 secs) and this using no tooling and without depalletizing.

BRIEF DESCRIPTION OF DRAWINGS

Other characteristics and advantages of the invention will be better understood after reading the additional description of the different embodiments given by way of illustration and with reference to the drawings, in which.

DETAILED DESCRIPTION OF THE PREFERRED EMBODIMENTS

Figure 1:
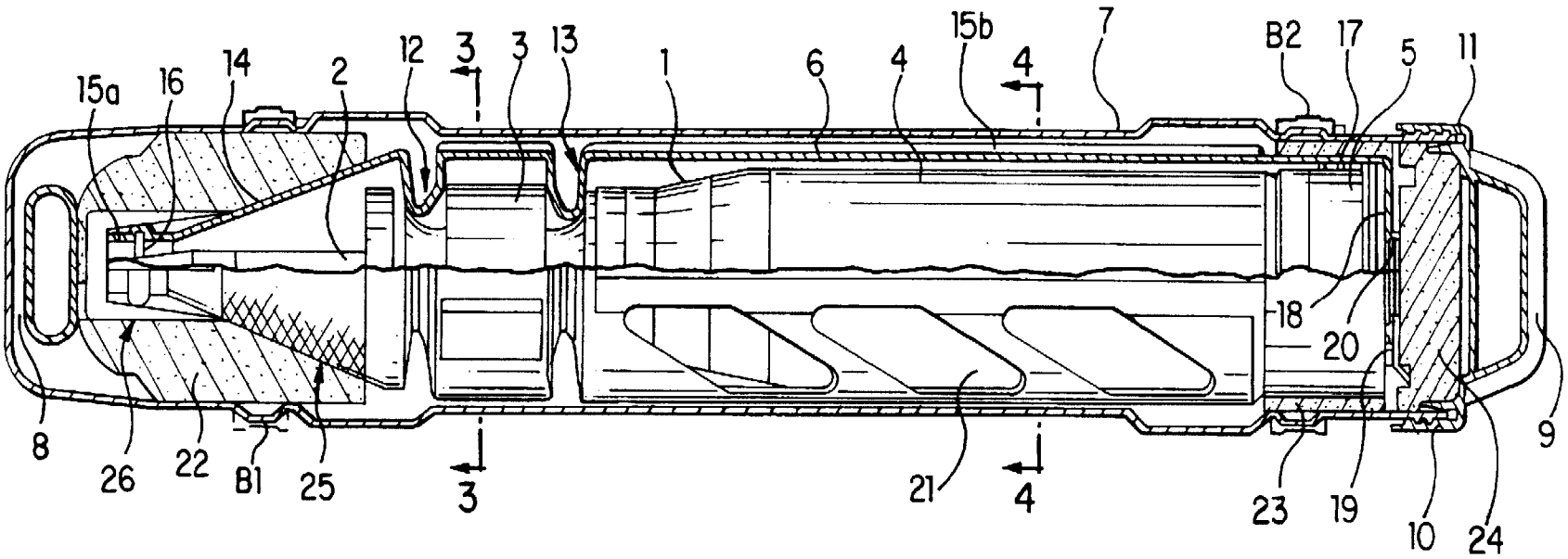
FIG. 1 is a longitudinal section view of a fin-stabilized munition in its container.

In FIG. 1, the upper part of the section shows the container according to the invention and the lower part shows a view of the inner envelope on its own incorporated into the outer envelope. The munition 1 shown in this figure is of the fin-stabilized type, i.e., it is composed of a projectile in the form of a core 2 integral with a sabot 3, and with a case 4, which may or may not be combustible, enclosing a propellant charge. The case 4 is finished off by a base 5. A large caliber munition of this type, 120 mm for example, has a mass of 17 kg and, according to the invention, any translation of the projectile with respect to the load is to be prevented, as it has been observed that this movement is the cause of an ill-timed initiation of the munition.

According to the invention, an inner envelope 6 is provided which is housed in an outer envelope 7. The latter is in all points conventional and comprises two operating handles 8 and 9 at each end, a cap 10 screwed to the outside of the envelope wall between which is placed a sealing O-ring 11. The inner envelope 6 is made of polyamide reinforced by glass fiber and made by injection-molding. In this way, a thin skeleton may be used, of around 5 mm thickness, both resistant and shock-absorbing. The inner envelope 6 is profiled so as to demarcate on its wall a first circular support 12 bearing on the sabot 3 in such a manner as to prevent any translation of the projectile towards the case 4 enclosing the load, this constituting the first blocking means when the munition falls on its base 5 end. The inner envelope 6 comprises a second circular support 13 bearing in a circular manner on the front end of the case 4, preventing any translation of this case enclosing the load towards the projectile core 2, and thus constituting the second blocking means when the munition falls on its projectile end.

FIG. 1 shows that the inner envelope 6 matches the general shape of the munition 1 and, on its projectile end, has a tapered part 14 extended at the front by a cylindrical part 15*a* bearing on a plugwasher 16 with respect to the projectile core 2 and at the rear by a tubular part 15*b*. The end of the inner envelope 6 is open and surrounds the tip of the projectile core 2 in order to provide it with extra protection. The inner envelope 6 further comprises at the base 5 a bearing surface formed of one or several supports 17. At this end, the envelope 6 is extended by a radial wall 18 which act as a bottom.

The inner envelope 6 can be made in the form of two half-shells joined by linking means in the middle, for example, by a snap-lock and/or a frog latch 19 fastened to a rim of the radial wall 18.

The inner envelope 6 thus structured ensures immobilization in three directions of the munition preventing any translation of any of its component parts with respect to the inner envelope. This inner envelope makes a fundamental contribution to performance during falls in safety tests. The lower part of FIG. 1 shows different material cut-outs 21 in the inner envelope 6.

The inner envelope 6 is itself immobilized in the three directions with respect to the outer envelope 7 by means of a head wedge 22, a side wedge 23 and a bottom wedge 24. The head wedge 22 is tightly fitted into the outer envelope 7 and has an axial recess demarcating a tapered inner profile 25 matching the tapered part 14 of the inner envelope, and a roughly cylindrical profile 26 accommodating, with a lot of give, the cylindrical part 15*a* of the inner envelope 6.

The side wedge 23 is applied against the roughly cylindrical part of the inner envelope 6 and is designed to prevent any movement perpendicular to the longitudinal axis, between the two envelopes. In FIG. 1, it is placed in the vicinity of the base 5 of the munition. The bottom wedge 24 is applied against the radial wall 18 of the envelope 6 and provides, further to its compression by the cap 10, blocking for the munition along its longitudinal axis. The three wedges 22, 23 and 24, thus designed, provide blocking in the three directions of the inner envelope 6 with respect to the outer envelope 7.

Figure 2:
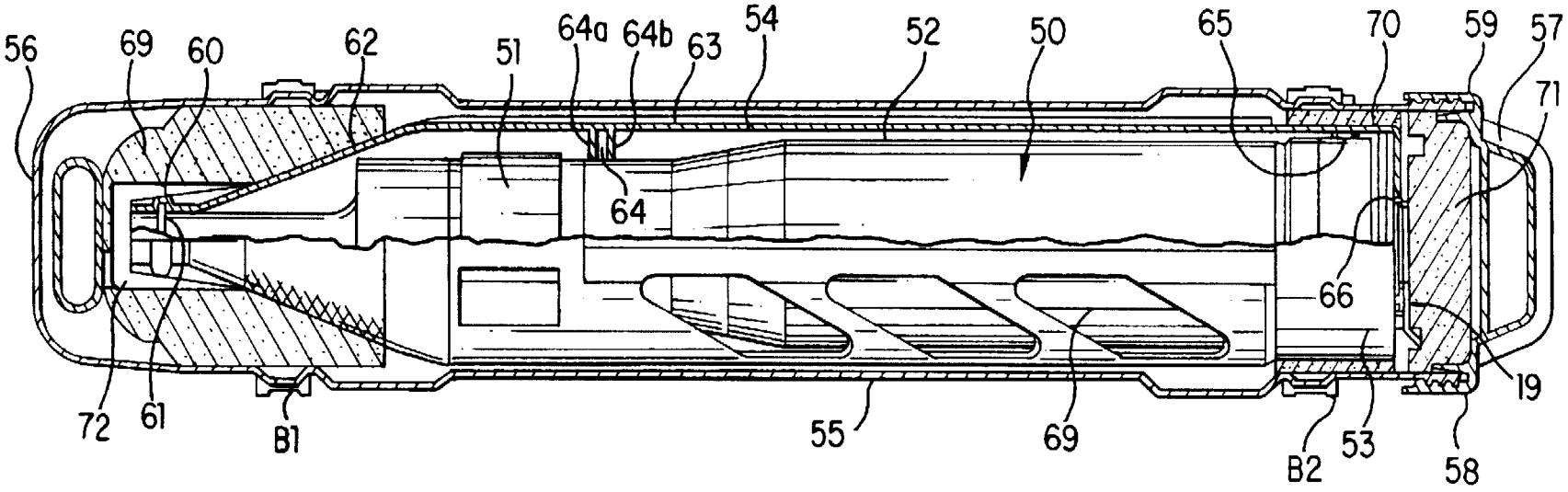
FIG. 2 is a longitudinal section view of a shaped charge munition in its container.

FIG. 2 shows a section of a container according to the invention applied to a munition of the shaped charge type. The munition 50 shown in this figure is composed of a shaped charge projectile 51, a case 52, which may or may not be combustible, enclosing a propellant charge. The case 52 is finished off by a base 53. A large caliber munition of this type, 120 mm for example, has a mass of 25 kg and, according to the invention, any translation of the projectile with respect to the pyrotechnic initiation system is to be prevented, as it has been observed that this movement causes ill-timed initiation of the munition.

According to the invention, half-shells 54 are provided, as above, housed in an outer envelope 55. The latter is quite practical and comprises two operating handles 56 and 57 at each end, a lid 58 screwed to the outside of the envelope 55 wall between which is placed a sealing O-ring 59. The half-shells 54 are made of reinforced technopolymer. In this way, a thin skeleton of a few millimeters in thickness can be produced, depending on the munition, which is both resistant and shock-absorbing. The half-shells 54 are profiled so as to demarcate on their wall a first support 60 to hook them onto the flange 61 of the shell so as to prevent any translation of the projectile 51 towards the case 52 enclosing the load, constituting the blocking means when the munition falls onto its base 53 end or onto its projectile 51 end.

Figure 3:
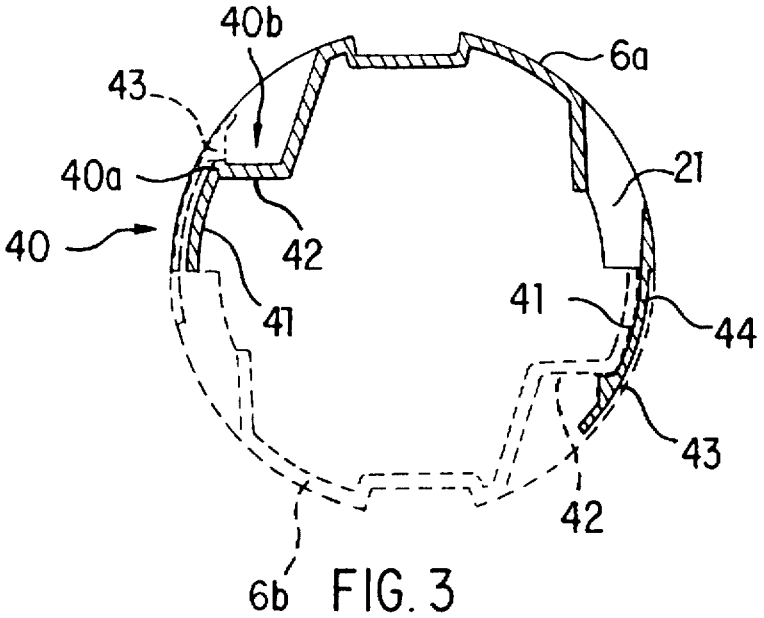
FIG. 3 is a transversal section view along line 3—3 in FIG. 1 showing the snap-locking means.

FIG. 3 shows a transversal section view of an embodiment of the first linking means of the two half-shells. It is made up of a snap-lock lip 40 demarcated by the wall itself of the two half-shells. Each half-shell 6*a* or 6*b* comprises on one side a snug 40*a* demarcated by a semi-cylindrical part 41 and a roughly flat part 42, and on the other a claw 43 demarcated by an extension 44 of the wall which makes up the lip itself. By hooking the claw 43 onto the snug 40 of the two half-shells 6*a* and 6*b*, they are linked together by their front parts. The flat part 42 demarcates an empty space 40*b* enabling the two half-shells 6*a* and 6*b* to be uncoupled by hand.

Figure 4:
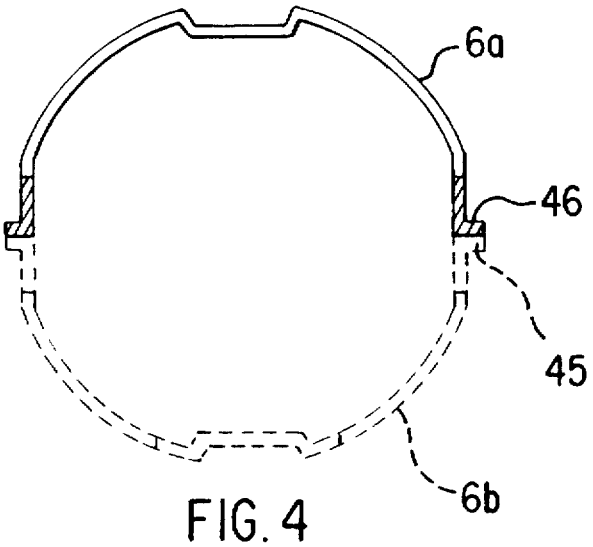
FIG. 4 is a transversal section view along line 4—4 in FIG. 1 of a specific structure of the inner container.

As shown in FIG. 4, the two half-shells 6*a* and 6*b* are each fitted with a rim 45 or 46. The two rims 45 and 46 are provided on the roughly cylindrical part 15*b* of the envelope 6 and ensure a clean contact with the two half-shells.

Figure 5B:
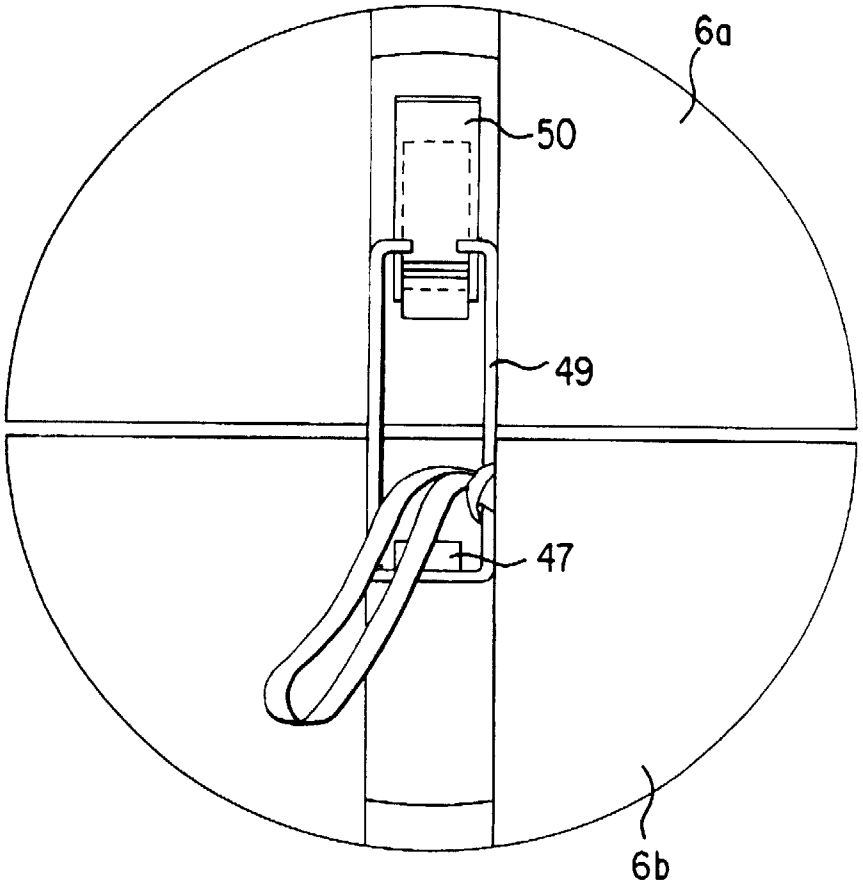
FIGS. 5A and 5B show the locking means at the base of the munition.
Figure 5A:
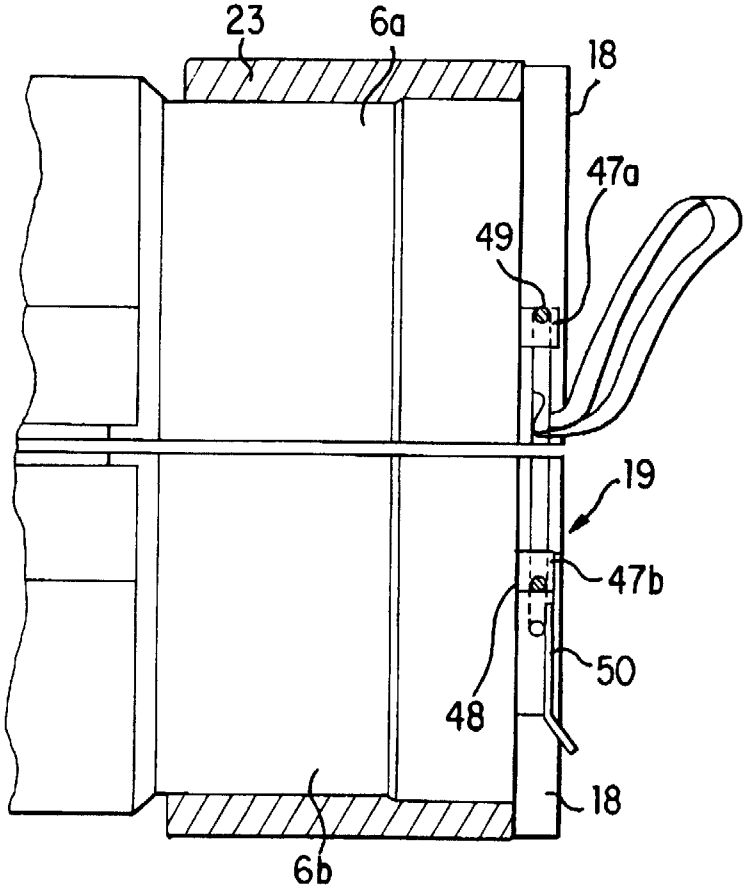

Figure 5A shows in greater detail the frog latch 19 which constitutes a second linking means for the two half-shells 6*a* and 6*b*. To this end, each half-shell 6*a* and 6*b* comprises, on its wall 18, a projecting extension 47*a* or 47*b* upon each of which a groove 48 is made. The groove 48 of half-shell 6*a*, for example, accommodates one end of a collar 49 of the frog latch, whereas the groove 48*b* of half-shell 6*b* accommodates a bar 50.

By maneuvering the bar 50, the frog latch 19 is locked at the bottom 18. The two half-shells 6*a* and 6*b* are thus firmly held together by the linking means shown in FIGS. 3 and 5.

Figure 6:
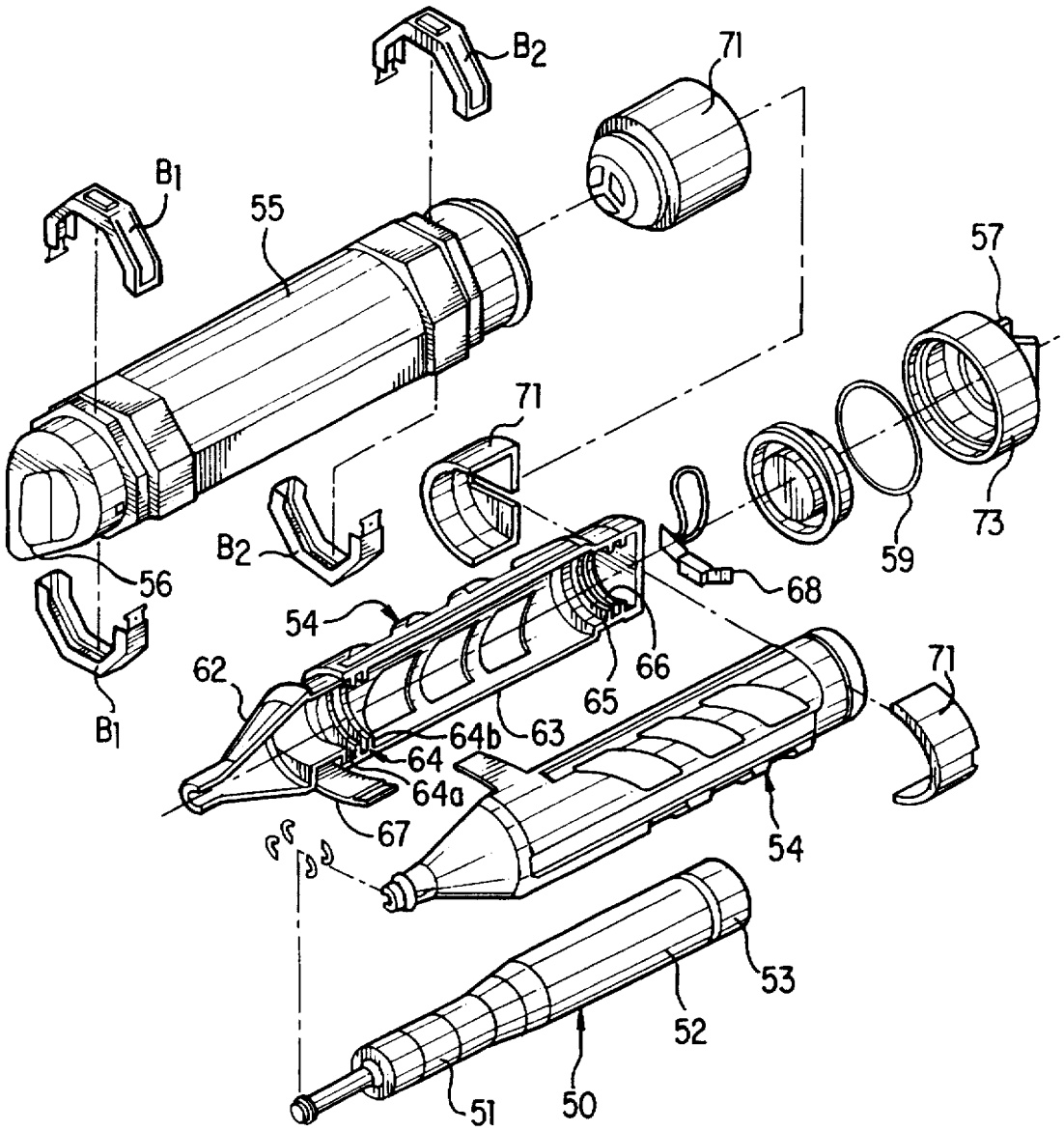
FIG. 6 is an exploded view showing the packaged munition.

FIGS. 1 and 2 show an outer envelope 7 of a type which is well known. This is made in the form of an extrusion blow-molded body of a viscoelastic material having high shock-absorbing properties of the polyethylene type having a high molecular weight (500,000). As shown in FIG. 6, this body is fitted with straps B1 and B2 which enables it to be conditioned on pallets without any other device.

The munition 4, thus protected, resists falls of 12 m with maximum safety shock-absorption. Tests carried out at temperatures of between −40° C. and +60° C. from heights of 12 m did not reveal initiation or disorganization of the munition for falls onto the base or projectile end, or on the side.

FIG. 6 shows that the half-shells 54, of FIG. 2, match the general shape of the munition and on the projectile end have a tapered part 62 extended by a cylindrical part 63. Each half-shell is fitted with a hooking groove 64 demarcated by two supports 64*a* and 64*b* constituting the second hooking means. These half-shells 54 further comprise adjacent the munition base 53, a bearing surface formed of one or several supports 65. At this end, each half-shell is extended by a radial wall 66.

These half-shells 54 can be joined together by linking means composed, for example, in the middle by a snap-lock lip 67 and a frog latch 68 fastened to the rim of the radial walls 66.

The half-shells 54 thus fitted together ensure immobilization of the munition 50 in three directions and prevent any translation of any of its component parts with respect to the inner envelope. This envelope make a fundamental contribution to the performance during falls in safety tests. The lower part in FIG. 2 shows different cut-outs 69 of light skeleton structure material, resistant and shock-absorbing, in the inner envelope.

The half-shells 54 are themselves immobilized in three directions with respect to the outer envelope 55 by means of a bottom wedge 71, a head wedge 69 and a side wedge 70. The head wedge 69 is tightly fitted into the outer envelope 55 and has an axial recess 72 demarcating a tapered inner profile matching the tapered part 62 of the half-shells and a roughly cylindrical recess accommodating, with a lot of give, the cylindrical part of the nose of the half-shells.

The wedge 70 is applied against the roughly cylindrical end part 63 of the half-shells and is designed to prevent any movement perpendicular to the longitudinal axis, between the two inner 54 and outer 55 envelopes. In FIG. 6 it is shown placed in the vicinity of the base 53 of the munition. The lid wedge 71 is applied against the bottom of the half-shells 54 and, by means of the lid 73, contributes towards blocking the munition along the longitudinal axis. The three wedges 69, 70 and 71, thus designed, in turn provide blocking for the half-shells 54 in three directions with respect to the outer envelope 55.

The container according to the invention avoids the initiation of the munition for heights of 12 m at temperature ranges between −40° C. and +60° C.

We claim:

1. A container for a large caliber munition, said container comprising:

an outer envelope closed by a cap;

an inner envelope for enclosing and holding the entire munition and fully enclosed by the outer envelope, the inner envelope having means for preventing translation of the munition with respect to the outer envelope, a tapered outer part on one end and a cylindrical part having a radial wall serving as a bottom on the other end;

a head wedge positioned in the outer envelope and fitted with a recess demarcating a tapered inner profile which matches the tapered outer part of the inner envelope:

a side wedge positioned between the inner and outer envelopes; and a bottom wedge applied against the radial bottom wall of the inner envelope and compressed by the cap.

2. The container according to claim 1, wherein the head wedge has a cylindrical inner profile extending from the inner tapered profile.

3. The container according to claim 1, wherein the munition is a fin-stabilized munition and said means for preventing translation is composed of a first and second blocking means to prevent translation of the munition.

4. The container according to claim 3, wherein the first and second blocking means are circular supports bearing on the munition.

5. The container according to claim 4, wherein the circular supports are folds formed in the inner envelope.

6. The container according to claim 1, wherein the munition is a shaped-charge munition and said means for preventing translation is composed of a support engageable with a flange of the munition.

7. The container according to claim 6, and the munition has a projectile and a case mated together, wherein the inner envelope has a plurality of supports bearing on the projectile proximate whereat the projectile and case are mated.

8. The container according to claim 1, wherein the inner envelope is formed of two half-shells having linking means for joining the two half-shells to one another.

9. The container according to claim 8, wherein said linking means is composed of snap-locking means positioned on the inner envelope to attach the half-shells and by a frog latch positioned in the vicinity of the radial bottom of the inner envelope.

10. The connector according to claim 9, wherein said snap-locking means includes a claw on each of the half-shells provided on an extension of each of the half-shells.

11. The container according to claim 8, wherein the two half-shells each have a bearing rim along a join line thereof.

12. The container according to claim 1, wherein the inner envelope is composed of injection-molded polyamide reinforced by glass fibers.

13. The container according to claim 1, wherein the inner envelope has cut-outs provided therein.

14. The container according to claim 1, wherein said means for preventing translation is composed of a first and second blocking means to prevent translation of the munition.

15. The container according to claim 1, wherein said means for preventing translation is composed of a support engageable with a flange of the munition.

16. The container according to claim 6, wherein the inner envelope has a plurality of supports bearing on the munition proximate whereat a projectile and a case of the munition are mated.

* * * * *